United States Patent [19]

Gebauer

[11] 4,082,622

[45] Apr. 4, 1978

[54] ELECTRODEPOSITION OF RUTHENIUM

[75] Inventor: Bodo G. Gebauer, Algonquin, Ill.

[73] Assignee: GTE Automatic Electric Laboratories Incorporated, Northlake, Ill.

[21] Appl. No.: 789,176

[22] Filed: Apr. 20, 1977

[51] Int. Cl.[2] ..... C25D 5/10; C25D 7/00

[52] U.S. Cl. ..... 204/40; 200/268; 204/DIG. 9; 204/46 G; 204/47

[58] Field of Search ..... 204/40, DIG. 9, 47, 204/385, 46 G; 200/268

[56] References Cited

U.S. PATENT DOCUMENTS

| | | | |
|---|---|---|---|
| 3,630,856 | 12/1971 | Meyer | 204/47 X |
| 3,749,650 | 7/1973 | Dettke et al. | 204/DIG. 9 X |

*Primary Examiner*—G. L. Kaplan

[57] ABSTRACT

A method for the electrodeposition of a relatively thick (20 to 45 microinches) layer of ruthenium includes the step of pulse current plating an intermediate layer of gold over the substrate to be plated. The ruthenium layer so obtained is characterized by low internal stress and an absence of surface cracks.

4 Claims, No Drawings

ELECTRODEPOSITION OF RUTHENIUM

BACKGROUND OF THE INVENTION

1. Field of the Invention

The invention relates to a method for the electrodeposition of ruthenium and in particular to a method for the electrodeposition of relatively thick layers of ruthenium.

2. Description of the Prior Art

Increasingly, attention has been focused on the use of ruthenium in electrical contact applications, such as in reed switches. It is priorly known that a reed switch contact may be formed on a nickel-iron alloy contact support or reed by depositing a gold layer on the nickel-iron alloy surface and thereafter depositing a layer of ruthenium. Examples of such reed switch contacts may be found in U.S. Pat. Nos. 3,663,777 issued May 16, 1972; 3,889,098 issued June 10, 1975; and 3,916,132 issued Oct. 28, 1975 all to A. Steinmetz et al. Typically, such prior art ruthenium contacts are deposited by means of sputtering techniques. The ruthenium layers so formed are relatively thin.

Another technique of forming relatively thin ruthenium layers is the electrodeposition of a ruthenium coating by employing an aqueous electrolyte solution of ruthenium in conjunction with continuous direct current densities.

It is desirable in certain instances to provide relatively thick, e.g., 20 to 45 microinches (0.5 to 1.125 micrometers), coatings. One problem with such coatings obtained by conventional techniques is that the ruthenium coating is characterized by severe internal stress resulting in the formation of cracks in the coating. This problem has been found to become more significant where a thick ruthenium layer is electrodeposited over a remanently magnetic material of the type generally known as "remendur." One example of a remendur composition is taught in U.S. Pat. No. 3,364,449 issued Jan. 16, 1968 to H. L. B. Gould et al.

One solution to the general problem of obtaining thick stress-free electrodeposits of ruthenium is disclosed in U.S. Pat. No. 3,630,856 issued Dec. 28, 1971 to A. Meyer. According to that patent, a stress-free ruthenium deposit may be obtained by utilizing an indium, gallium, or thallium addition to the electrolyte plating solution.

In *Gold Plating Techniques,* F. H. Reed et al, Electrochemical Publications Limited, Scotland, 1974, at page 65 it is reported that a technique known as pulsed current plating may be employed to produce a less nodular, finer grain deposit of gold than can be obtained using direct current electrodeposition. According to this technique, the plating current source produced a pulsed current output, i.e., a current is generated for a first time period and is absent during a second time period, the first and second time periods reoccur cyclically.

SUMMARY OF THE INVENTION

It is believed that the surface structure upon which ruthenium is plated determines the degree of stress in the ruthenium layer regardless of the type of bath or mode of deposition. It has been determined by experiment as described herein below that a relatively thick layer of ruthenium characterized by low internal stress may be obtained by proper deposition of an intermediate layer of gold.

In accordance with the principles of the invention, a relatively thick ruthenium layer characterized by low internal stress may be deposited on a metal base by pulse current plating an underlying layer of gold, over the metal base.

Further, in accordance with the principles of the invention, a relatively thick layer of stress-free ruthenium is electrodeposited on a remanently magnetic material by pulse current plating an intermediate layer of gold over the surface of the remanently magnetic material.

For the purpose of giving those skilled in the art a better understanding of the invention, the following illustrative example is given:

EXAMPLE

A substrate of remendur material has been prepared for plating by:

1. immersion in a suitable cleaning solution for 2 minutes with ultrasonic agitation;
2. rinsing in de-ionized water;
3. cathodic cleaning in a bath of 5% sulfuric acid for 2 minutes at a current density of 5 amp/ft$^2$; and
4. rinsing for 1 minute with de-ionized water.

The clean substrate was pulse current plated with a gold layer by means of a soft neutral gold plating bath with the following characteristics:

gold: 7.8 to 8.6 grams/liter
viscosity: 17° to 20° Baume'
PH: 5.8 to 6.0
temperature of the bath: 60° ± 10° C The operating parameters of the power supply were:
pulse cycle: 9.6 milliseconds on 44.0 milliseconds off
current density: 11.5 amp/ft$^2$ at peak current for an immersion depth of 0.280 inches.

After 6 to 7 minutes, the gold coating obtained had a thickness of 40 microinches. The gold plating was followed by two 1 minute rinses with de-ionized water.

A layer of ruthenium was then electrodeposited using conventional direct current plating by means of the following bath:

Ruthenium: 9–10 grams/liter as a complex of $(NH_4)_3$ $[Ru_2NCl_8(H_2O)_2]$
PH adjusted to: 1.15 – 1.5 by means of $H_2SO_4$
temperature of the bath: 60°–70° C
current density: 5 amp/ft$^2$.

The ruthenium layer so obtained had a nominal thickness of 30 microinches.

The plated remendur was then twice rinsed for one minute with de-ionized water and then rinsed by means of a 5-stage cascade high purity polished water rinse. The plated remendur was then centrifuge dried at 212° F for 10 minutes.

A bright coating of ruthenium was obtained on the remendur sample precoated with the pulse current plated gold layer which showed no cracks at magnifications of 600 times.

Further experiments indicate that a minimum thickness for the gold layer is 30 microinches for ruthenium layers of approximately 20 to 40 microinches.

Although the present invention has been described in conjunction with a preferred embodiment, it is to be understood that modifications and variations may be resorted to without departing from the spirit and scope of the invention as those skilled in the art will readily understand. Such modifications and variations are considered to be within the purview and scope of the invention and appended claims.

What is claimed is:

1. A process for electroplating a surface of a metal article with ruthenium which comprises:

pulse current plating a layer of gold on the surface of said metal article, and electroplating a ruthenium layer on said gold layer.

2. A process according to claim 1 wherein said metal article comprises a remenantly magnetic material.

3. A process according to claim 1 wherein said gold layer has a minimum thickness of approximately 30 microinches.

4. A process according to claim 1 wherein said ruthenium layer has a thickness of 20 to 40 microinches.

* * * * *